US006662507B1

(12) United States Patent
Bendy

(10) Patent No.: US 6,662,507 B1
(45) Date of Patent: Dec. 16, 2003

(54) WINDOW ANTI-FOG SYSTEM

(76) Inventor: Kerry J. Bendy, P.O. Box 49, St. Michael, ND (US) 58370

( * ) Notice: Subject to any disclaimer, the term of this patent is extended or adjusted under 35 U.S.C. 154(b) by 0 days.

(21) Appl. No.: 10/155,645

(22) Filed: May 22, 2002

(51) Int. Cl.[7] ..... E06B 7/00; E06B 3/00
(52) U.S. Cl. ..... 52/171.3; 52/204.5
(58) Field of Search ..... 52/171.3, 204.5

(56) References Cited

U.S. PATENT DOCUMENTS

| | | | | | |
|---|---|---|---|---|---|
| 3,889,434 | A | * | 6/1975 | Shelver | 52/172 |
| 4,033,087 | A | * | 7/1977 | Shelver | 52/745.15 |
| 4,037,079 | A | * | 7/1977 | Armbruster | 219/219 |
| 5,878,538 | A | * | 3/1999 | Rossini | 52/171.3 |
| 6,209,269 | B1 | * | 4/2001 | Valderrama | 52/171.3 |

FOREIGN PATENT DOCUMENTS

| | | |
|---|---|---|
| SE | WO 89/03925 | * 10/1987 |

* cited by examiner

*Primary Examiner*—Carl D. Friedman
*Assistant Examiner*—Kevin McDermott

(57) ABSTRACT

A window anti-fog system for preventing fogging between windowpanes. The window anti-fog system includes an aperture within a lower portion of a first windowpane, a gas container containing a pressurized volume of gas, and a delivery tube fluidly connected to the gas container with a distal portion inserted within the aperture within the first windowpane. The delivery tube preferably has a size smaller than the aperture for allowing air to escape, however, another opening within the windowpane may be utilized. The gas container preferably contains a gas lighter than air such as nitrogen. A valve between the gas container and the delivery tube controls the flow of the gas into the interior cavity between the first windowpane and a second windowpane.

18 Claims, 4 Drawing Sheets

WINDOW ANTI-FOG SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to windows and more specifically it relates to a window anti-fog system for preventing fogging between windowpanes.

2. Description of the Related Art

Insulated window units have been in use for years. Conventional insulated window units utilizes a pair of transparent windowpanes secured within a frame defining a sealed interior cavity filled with a gas such as air or argon gas. The windowpanes are typically bonded together using aluminum, foam, or butyl spacers.

The main problem with conventional insulated windows is that moisture eventually enters the interior cavity between the windowpanes thereby fogging the interior surfaces of the windowpanes during temperature changes making it difficult to see through. Another problem with conventional insulated windows is that the argon gas will eventually dissipate over time. Another problem with conventional insulated windows is that they must be replaced with a costly new window after becoming contaminated with moisture within the interior cavity between the windowpanes.

While these devices may be suitable for the particular purpose to which they address, they are not as suitable for preventing fogging between windowpanes Conventional insulated windows are not suitable for long-term anti-fog protection.

In these respects, the window anti-fog system according to the present invention substantially departs from the conventional concepts and designs of the prior art. and in so doing provides an apparatus primarily developed for the purpose of preventing fogging between windowpanes.

BRIEF SUMMARY OF THE INVENTION

In view of the foregoing disadvantages inherent in the known types of window anti-fogging systems now present in the prior art, the present invention provides a new window anti-fog system construction wherein the same can be utilized for preventing fogging between windowpanes.

The general purpose of the present invention, which will be described subsequently in greater detail, is to provide a new window anti-fog system that has many of the advantages of the window anti-fogging systems mentioned heretofore and many novel features that result in a new window anti-fog system which is not anticipated, rendered obvious, suggested, or even implied by any of the prior art window anti-fogging systems, either alone or in any combination thereof.

To attain this, the present invention generally comprises an aperture within a lower portion of a first windowpane, a gas container containing a pressurized volume of gas, and a delivery tube fluidly connected to the gas container with a distal portion inserted within the aperture within the first windowpane. The delivery tube preferably has a size smaller than the aperture for allowing air to escape, however, another opening within the windowpane may be utilized. The gas container preferably contains a gas lighter than air such as nitrogen. A valve between the gas container and the delivery tube controls the flow of the gas into the interior cavity between the first windowpane and a second windowpane. As the gas rises within the interior cavity, the gas eventually displaces the air within the interior cavity thereby forcing the air outwardly through the aperture about the delivery tube. This process continues during the life of the window unit to ensure that moisture and air do not enter the interior cavity. If a gas heavier than air is desired, such as argon gas, then the aperture is positioned within an upper portion of the first windowpane.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a window anti-fog system that will overcome the shortcomings of the prior art devices.

A second object is to provide a window anti-fog system for preventing fogging between windowpanes.

Another object is to provide a window anti-fog system that may be utilized within existing or new window units.

An additional object is to provide a window anti-fog system that provides continuous anti-fog protection between windowpanes.

A further object is to provide a window anti-fog system that is easy to install and utilize.

Another object is to provide a window anti-fog system that reduces the need to replace windows thereby saving money.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
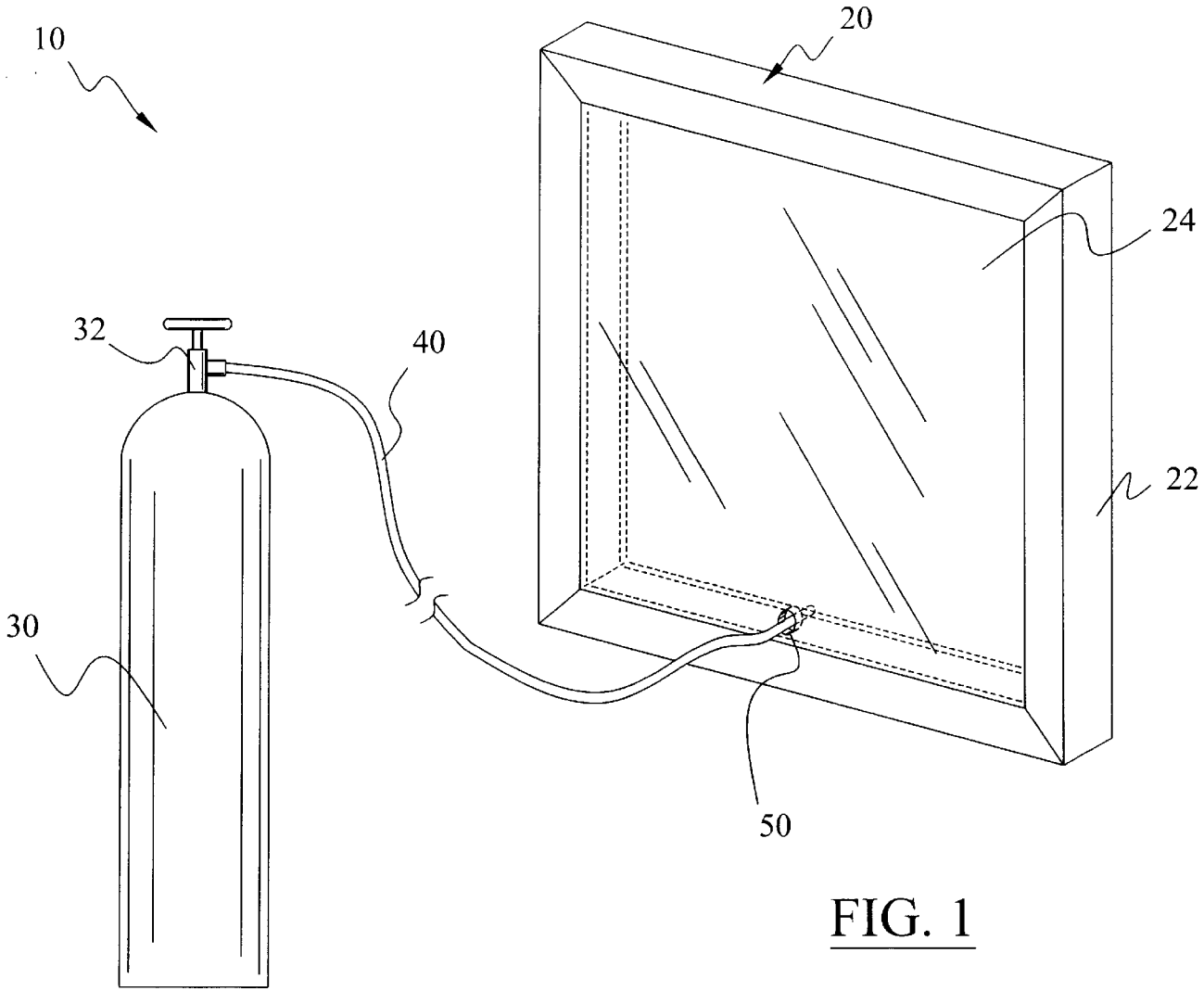
FIG. 1 is an upper perspective view of the present invention with the aperture and delivery tube within the lower portion of the first windowpane when utilizing a gas lighter than air.

Turning now descriptively to the drawings, in which similar reference characters denote similar elements throughout the several views, FIGS. 1 through 4 illustrate a window anti-fog system 10, which comprises an aperture 50 within a lower portion of a first windowpane 24, a gas container 30 containing a pressurized volume of gas, and a delivery tube 40 fluidly connected to the gas container 30 with a distal portion inserted within the aperture 50 within the first windowpane 24. The delivery tube 40 preferably has a size smaller than the aperture 50 for allowing air to escape, however, another opening within the windowpane may be utilized. The gas container 30 preferably contains a gas lighter than air such as nitrogen. A valve 32 between the gas container 30 and the delivery tube 40 controls the flow of the gas into the interior cavity 28 between the first windowpane 24 and a second windowpane 26. As the gas rises within the interior cavity 28, the gas eventually displaces the air within the interior cavity 28 thereby forcing the air outwardly through the aperture 50 about the delivery tube 40. This process continues during the life of the window unit 20 to ensure that moisture and air do not enter the interior cavity 28. If a gas heavier than air is utilized, such as argon gas, then the aperture 50 is positioned within an upper portion of the first windowpane 24.

Figure 3:
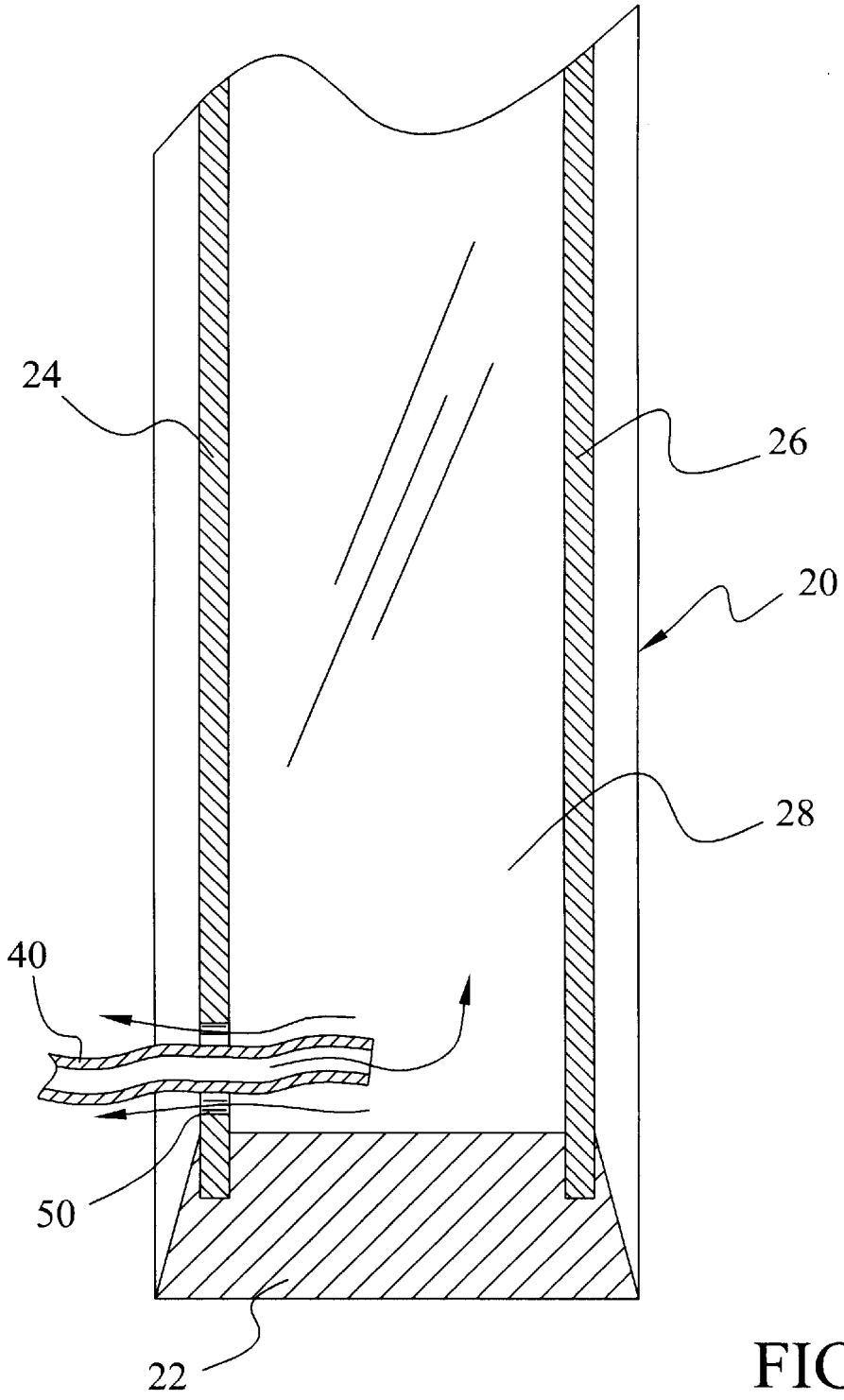
FIG. 3 is a cross sectional view taken along line 3—3 of FIG. 2.

As shown in FIG. 3 of the drawings, the window unit 20 is comprised of a first windowpane 24 and a second windowpane 26 secured within a frame 22 forming a sealed interior cavity 28. The frame 22 may be comprised of wood, vinyl, aluminum or other material commonly utilized to manufacture a window unit 20. The shape of the windowpanes 24, 26 and the frame 22 may be comprised of various well known shapes such as but not limited to rectangular, square, circular, oval and the like. The present invention may be utilized with a new window unit 20 manufactured to receive the delivery tube 40, or the aperture 50 may be created within an existing window unit 20 to receive the delivery tube 40.

Figure 2:
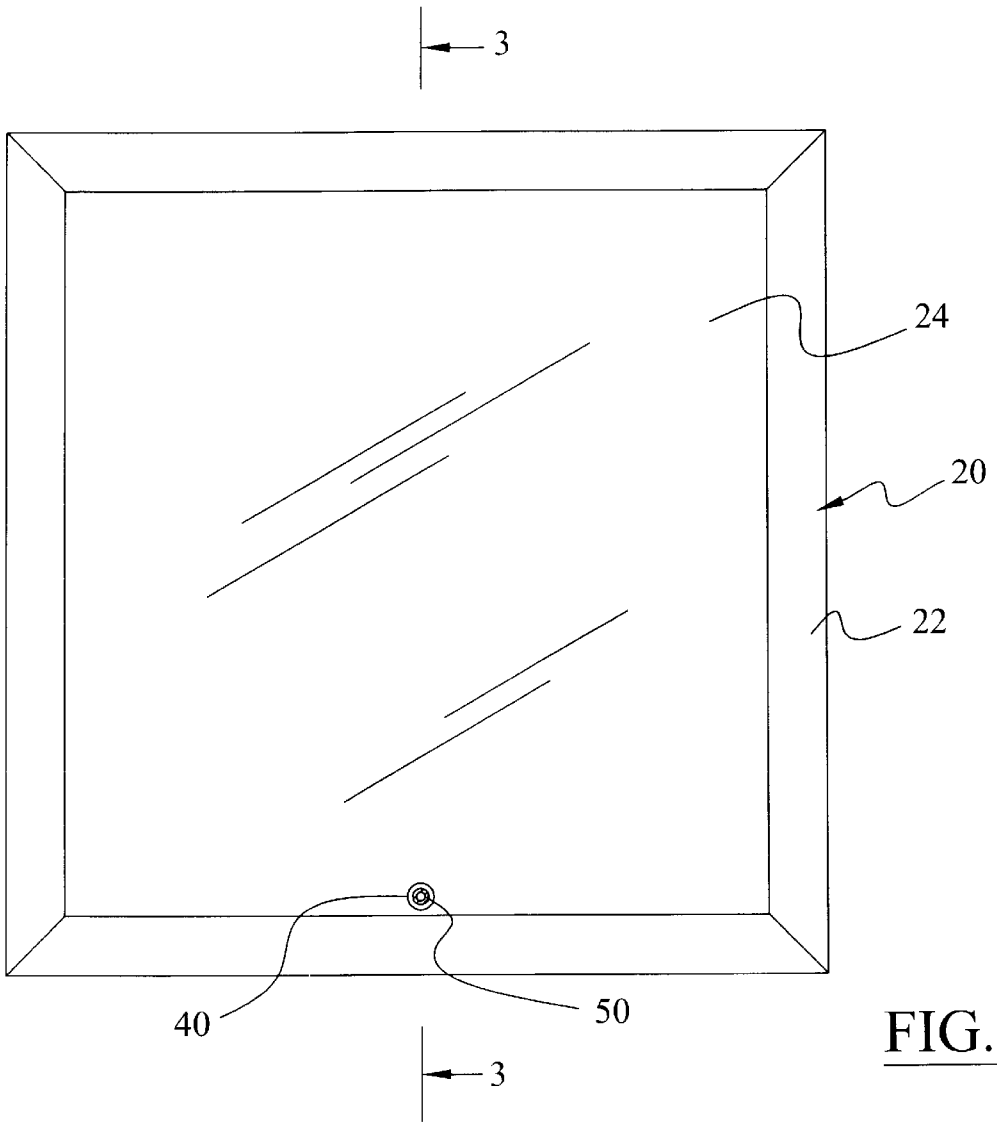
FIG. 2 is a front view of the delivery tube within the window unit.

As shown in FIGS. 1 through 3 of the drawings, an aperture 50 extends within a lower portion of the first windowpane 24 of the window unit 20. The first windowpane 24 is preferably the interior windowpane of the window unit 20, though not required. The aperture 50 may be comprised of any shape and size, but is preferably larger than the outer portion of the delivery tube 40 as shown in FIGS. 2 and 3 of the drawings. The aperture 50 is preferably adjacent the lower portion of the frame 22 a finite distance such as to not weaken the first windowpane 24. The aperture 50 is formed utilizing conventional glass cutting tools such as a diamond head bit upon a drill or water cutting. Tools for cutting holes within glass are commonly utilized within the glass industry and further explanation of glass drilling techniques is not required.

The gas container 30 is comprised of any well-known container capable of storing a pressurized gas such as but not limited to nitrogen, argon or krypton. A valve 32 either directly upon the gas container 30 or remotely connected to the gas container 30 via a connection tube is utilized to control the flow of the gas from the gas container 30. A delivery tube 40 is fluidly connected to the valve 32 for delivering the gas into the interior cavity 28 defined between the first windowpane 24 and the second windowpane 26. A distal portion of the delivery tube 40 extends into the interior cavity 28 through the aperture 50 as best illustrated in FIG. 3 of the drawings. The size of the delivery tube 40 is preferably smaller than the aperture 50 thereby allowing air and gas to escape through from the interior cavity 28 as illustrated in FIG. 3 of the drawings. However, the delivery tube 40 may be sealed within the aperture 50 and an alternative opening within the first windowpane 24 allows the air and gas to escape while the delivery tube 40 dispenses the gas into the interior cavity 28.

Figure 4:
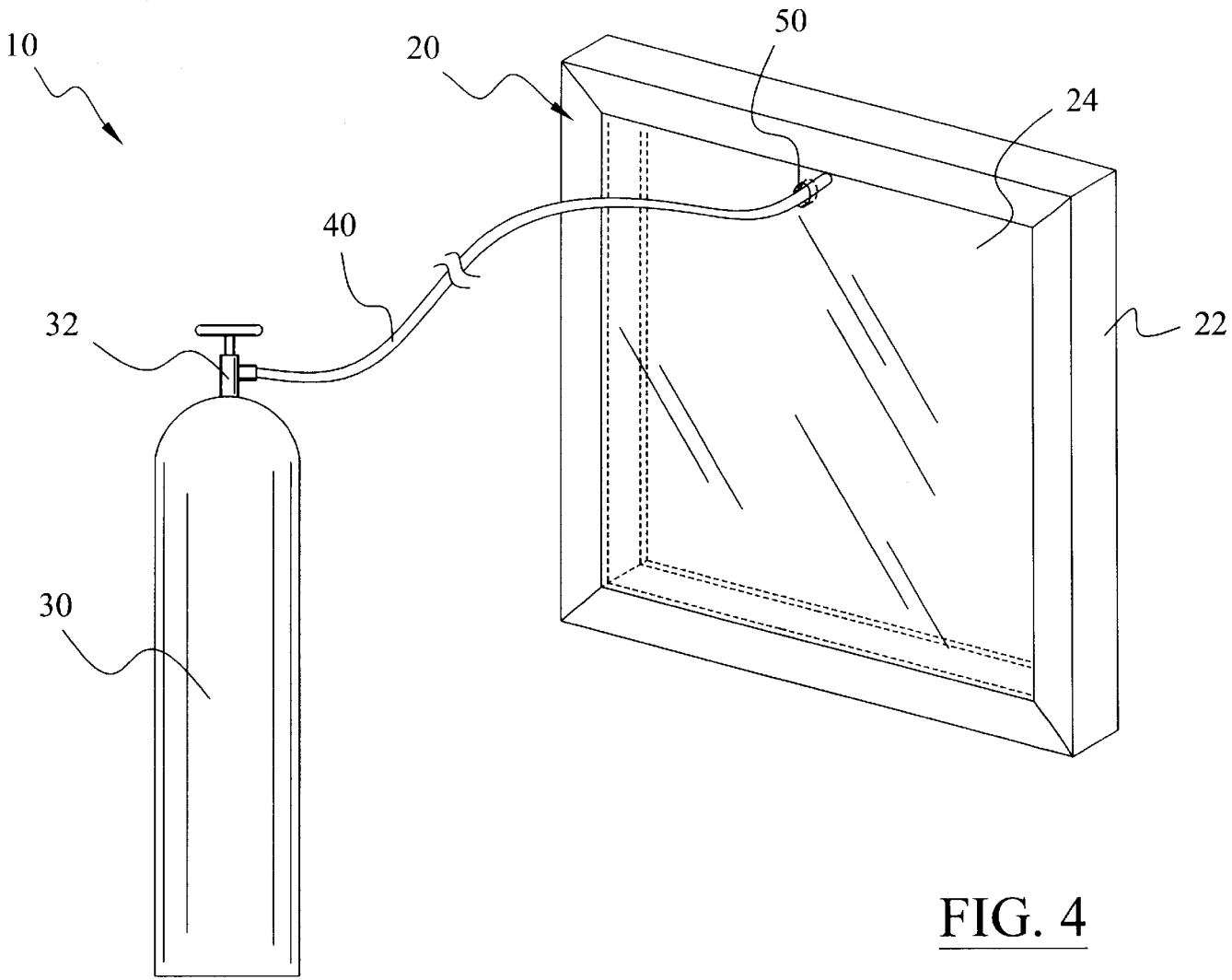
FIG. 4 is an upper perspective view of an alternative embodiment of the present invention with the aperture and delivery tube within the upper portion of the first windowpane when utilizing a gas heavier than air.

FIG. 4 illustrates an alternative embodiment of the present invention wherein the aperture 50 is positioned within an upper portion of the first windowpane 24 and the delivery tube 40 dispenses a gas heavier than air. Alternatively, the aperture 50 may also be positioned adjacent to the side portions of the window unit 20.

For the invention illustrated in FIGS. 1 through 3 of the drawings, a gas lighter than air is preferably utilized for first displacing the upper portions of the interior cavity 28 and thereby forcing the air downwardly out through the aperture 50. The preferred gas for this application is nitrogen, however various other gases may be utilized that are lighter than air.

For the invention illustrated in FIG. 4 of the drawings, a gas heavier than air is preferably utilized for first displacing the lower portions of the interior cavity 28 and thereby forcing the air upwardly out through the aperture 50. The preferred gas for this application is argon, however various other gases may be utilized that are heavier than air.

In use, the user determines the desired flow rate of the gas desired and adjusts the valve 32 accordingly. During the initial installation, the user may purge the interior cavity 28 by increasing the volume of gas flow and then decreasing the gas flow to the desired constant rate. The valve 32 allows the desired flow of gas from the gas container 30 through the delivery tube 40 into the interior cavity 28 of the window unit 20. The gas displaces the air within th& interior cavity 28 by forcing the air outward through the aperture 50. The user allows the continued flow of gas into the interior cavity 28 for a prolonged period of time thereby maintaining the interior cavity 28 free of moisture and air which keeps the interior surfaces of the window unit 20 fog free while providing the desired insulating qualities of a gas such as argon. The period of time that the gas is dispensed within the interior cavity 28 preferably is the period of time that the window unit 20 remains in usage which can easily exceed 5 years. It can be appreciated than an automated system may periodically dispense gas into the interior cavity 28 at predefined intervals.

As to a further discussion of the manner of usage and operation of the present invention, the same should. be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications. and changes will readily occur to those skilled in the art, it is not desired to limit the invention to the exact construction and operation shown and described, and accordingly, all suitable modifications and equivalents may be resorted to, falling within the scope of the invention.

I claim:

1. A window anti-fog system, comprising:

a window unit having a first windowpane and a second windowpane defining an interior cavity;

an aperture within said first windowpane;

a gas container storing a volume of pressurized gas; and a delivery tube fluidly connected to said gas container and extending through said aperture for dispensing said pressurized gas into said interior cavity.

2. The window anti-fog system of claim 1, wherein said aperture is larger in size than said delivery tube.

3. The window anti-fog system of claim 1, wherein said aperture is within a lower portion of said first windowpane.

4. The window anti-fog system of claim 3, wherein said pressurized gas is lighter than air.

5. The window anti-fog system of claim 4, wherein said pressurized gas is comprised of nitrogen.

6. The window anti-fog system of claim 1, wherein said aperture is within an upper portion of said first windowpane.

7. The window anti-fog system of claim 6, wherein said pressurized gas is heavier than air.

8. The window anti-fog system of claim 7, wherein said pressurized gas is comprised of argon.

9. The window anti-fog system of claim 1, including a valve fluidly connected between said delivery tube and said gas container for allowing control of a flow rate of said pressurized gas.

10. The window anti-fog system of claim 1, including a second aperture within said first windowpane.

11. A method of installing an anti-fog system within a window unit having a first windowpane and a second windowpane defining an interior cavity, said method comprising the steps of:

(a) creating an aperture within said first windowpane;

(b) inserting a delivery tube within said aperture, wherein said delivery tube is fluidly connected to a gas container containing a pressurized gas and a valve; and (c) opening said valve to allow a constant flow of said pressurized gas into said interior cavity of said window unit.

12. The method of installing an anti-fog system of claim 11, wherein said aperture is larger in size than said delivery tube.

13. The method of installing an anti-fog system of claim 11, wherein said aperture is within a lower portion of said first windowpane.

14. The method of installing an anti-fog system of claim 13, wherein said pressurized gas is lighter than air.

15. The method of installing an anti-fog system of claim 14, wherein said pressurized gas is comprised of nitrogen.

16. The method of installing an anti-fog system of claim 11, wherein said aperture is within an upper portion of said first windowpane.

17. The method of installing an anti-fog system of claim 16, wherein said pressurized gas is heavier than air.

18. The method of installing an anti-fog system of claim 17, wherein said pressurized gas is comprised of argon.

* * * * *